US005505381A

United States Patent [19]

Torntore

[11] Patent Number: 5,505,381

[45] Date of Patent: Apr. 9, 1996

[54] ROTATABLE, CLEANABLE, FLAT TIP HOLDER FOR AIRLESS SPRAYING

[75] Inventor: Anthony J. Torntore, Bloomington, Minn.

[73] Assignee: Wagner Spray Tech Corporation, Minneapolis, Minn.

[21] Appl. No.: 308,138

[22] Filed: Sep. 19, 1994

[51] Int. Cl.[6] ..... B05B 15/02

[52] U.S. Cl. ..... 239/119; 239/600

[58] Field of Search ..... 239/119, 600, 239/288–288.5

[56] References Cited

U.S. PATENT DOCUMENTS

| | | | |
|---|---|---|---|
| 3,116,882 | 1/1964 | Vork . | |
| 3,202,360 | 8/1965 | O'Brien . | |
| 3,593,920 | 7/1971 | Watson | 239/119 |
| 3,799,453 | 3/1974 | Hart | 239/600 |
| 3,831,862 | 8/1974 | Calder . | |
| 3,955,763 | 5/1976 | Pyle et al. | 239/119 |
| 4,116,386 | 9/1978 | Calder | 239/119 |
| 4,165,836 | 8/1979 | Eull | 239/119 |
| 4,437,610 | 3/1984 | Huber et al. | 239/119 |
| 4,483,481 | 11/1984 | Calder | 239/119 |
| 4,484,707 | 11/1984 | Calder | 239/119 |
| 4,508,268 | 4/1985 | Geberth, Jr. | 239/119 |
| 4,516,724 | 5/1985 | Hellman | 239/119 |
| 4,527,745 | 7/1985 | Butterfield et al. | 239/600 |
| 4,537,355 | 8/1985 | Calder | 239/119 |
| 4,611,758 | 9/1986 | Geberth, Jr. | 239/119 |
| 4,635,850 | 1/1987 | Leisi | 239/119 |
| 4,715,537 | 12/1987 | Calder | 239/119 |
| 4,736,892 | 4/1988 | Calder | 239/119 |
| 4,757,947 | 7/1988 | Calder | 239/119 |
| 4,830,281 | 5/1989 | Calder | 239/119 |
| 4,971,249 | 11/1990 | Tam et al. | 239/119 |
| 5,255,848 | 10/1993 | Rhodehouse | 239/119 |
| 5,280,853 | 1/1994 | Perret, Jr. | 239/119 |
| 5,294,053 | 3/1994 | Perret, Jr. | 239/119 |

FOREIGN PATENT DOCUMENTS

| | | | |
|---|---|---|---|
| 3632005 | 4/1988 | Germany | 239/600 |

*Primary Examiner*—Karen B. Merritt
*Attorney, Agent, or Firm*—Faegre & Benson

[57] ABSTRACT

A flat tip holder for an airless material spray system which incorporates a body adapted for attachment to an airless spray gun and a rotatable flat tip holder unit within the body for positioning the flat tip in a spray or cleaning position with a positively sealing element provided in the holder to seal the tip and holder along the material flow path when the unit is in either the spray or cleaning position.

8 Claims, 1 Drawing Sheet

ROTATABLE, CLEANABLE, FLAT TIP HOLDER FOR AIRLESS SPRAYING

FIELD OF THE INVENTION

This invention relates generally to spray tip devices for airless material spraying systems and more specifically to a spray tip holder which allows for rotation of the tip within the material flow path for cleaning thereof without removal of the tip from the spray gun and which maintains the sealed flow alignment of the elements of the tip holder during both operations.

SUMMARY OF THE INVENTION

A tip holder for an airless material spraying system which includes a body attachable to a controllable spray gun with the tip holder including a rotatable member which member houses the flat end spray tip and provides a flow passage therethrough for both material spraying and tip cleaning. The rotatable member includes a transverse, material flow tip mounting passage, a seal within the passage and a closure and locking cap having an adjustably mounted seal contacting plate moveable relative thereto to act against the seal which in turn seals against the tip.

The flat tip is initially inserted into the rotatable member, the seal placed thereagainst and the closure cap and integral plate inserted into the rotatable member.

The closure cap is then locked against movement. The plate is longitudinally adjustable with respect to the closure cap to exert proper sealing pressure against the flat spray tip and thus provides a sealed material flow path. This path is maintained for both spraying of material and cleaning of the tip which is accomplished by turning of the rotatable member to cause material flow rearwardly through the flat tip.

BACKGROUND AND OBJECTS OF THE INVENTION

Various methods and structures for airless spraying of materials are available. Many of the same operate in both a spraying and a cleaning position which allows for rotation of the flat end spray tip for cleaning of the same by the rearward flow of material therethrough. This concept eliminates disassembly of the tip and holder from the gun for cleaning purposes. The time and labor cost involved in disassembly and cleaning is significant.

With the applicant's unit, a rotatable, flat tip holder is provided which is rotatable and positionable within a spray tip body to provide two distinct positions. The first of such positions is, obviously, the material spraying position with the second being a reversed position in which material is directed oppositely through the tip to remove any particles or obstructions that may have lodged in the tip and which prevent proper spraying. Following reverse, cleaning, material flow, the unit is repositioned to proper material spray position.

Applicant's unit provides a unique structure for providing a seal between a tip capturing head and the tip holder such that proper sealing is maintained along the material flow path during spraying and cleaning.

It is therefore an object of the applicant's invention to provide a new and unique flat tip holder for airless spraying which allows rotation of the same within the material flow path to allow material to flow through the tip in both a spraying and in a cleaning direction.

It is a further object of the applicant's invention to provide a new and unique flat tip holder for airless spraying which includes structure to adjust the sealing pressure on an in-line seal to maintain the flat tip in proper material flow position and condition.

It is still a further object of the applicant's invention to provide a new and unique flat tip holder for airless spraying which includes a positionable holder member within a sprayer base to allow flow of material through the flat tip in both directions without being removed from the base.

These and other objects and advantages of the applicant's invention will more fully appear from the accompanying drawings and description of a preferred form of the invention.

DESCRIPTION OF A PREFERRED FORM OF THE INVENTION

Figure 1:
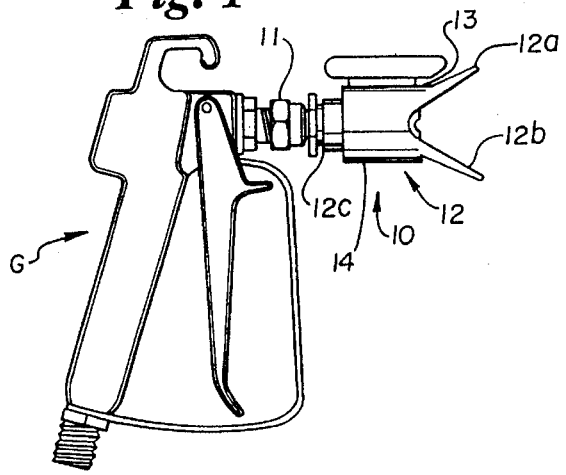
FIG. 1 is a side elevation of a typical airless spray gun having the flat tip holder embodying the concepts of the applicant's invention provided thereon.
Figure 2:
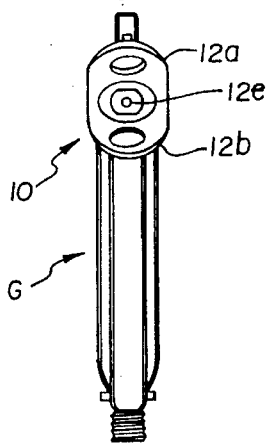
FIG. 2 is a front view thereof.
Figure 3:
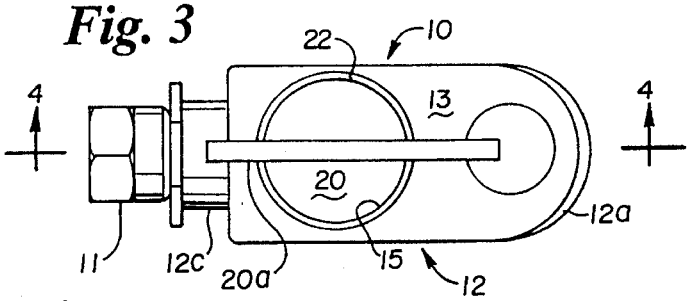
FIG. 3 is a top view of the tip holder.
Figure 4:
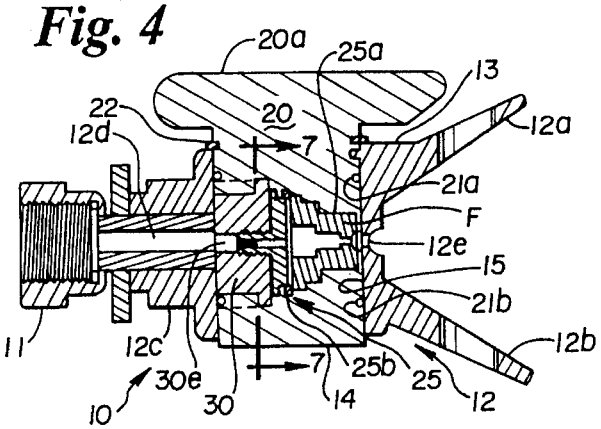
FIG. 4 is a vertical section taken substantially along Line 4—4 of FIG. 3.
Figure 6:
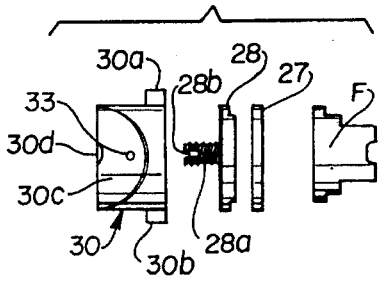
FIG. 6 is an exploded view of the tip holder portion of the unit.
Figure 5:
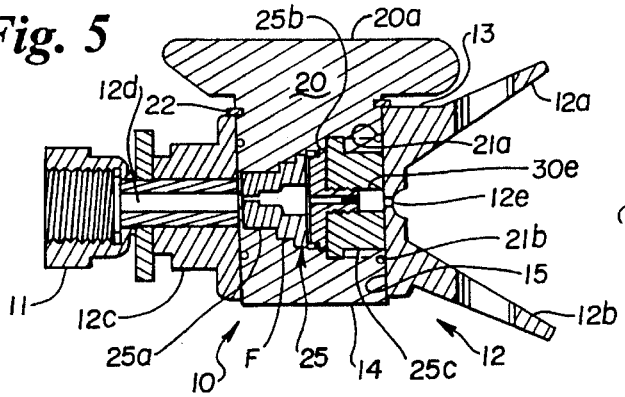
FIG. 5 is a view similar to FIG. 4 illustrating the rotation of the tip holder body for tip cleaning.

In accordance with the accompanying drawings, the tip holder embodying the concepts of the applicant's invention is designated in its entirety 10 and is illustrated in FIGS. 1 and 2 positioned on a typical airless spray gun G where it is fluidly attached to the gun G to receive the controlled flow of material therefrom. Persons acquainted with airless spray systems are aware of the pressures under which such systems operate and the requirement of positive fluid and pressure connections between a gun G and the spray tips. The illustrated connector 11 satisfies this requirement but is simply a means of attachment of the holder 10 to a gun G.

The tip holder 10 includes a main body or base 12, generally rectangular in shape and, in the form shown, including a pair of forwardly directed, diverging ears 12*a*, 12*b*, a connective end 12*c* accomodating connector 11 and having a material flow passage 12*d* therethrough. Flow passage 12*d* continues through the body 12 to exit at 12*e*. Body 12 also includes an upper 13 and lower surface 14.

As illustrated, a tip holder receiving passage 15 is formed from the upper 13 to lower 14 surface of body 12. This passage 15 is illustrated as passing entirely through body 12 but, it should be obvious that this through passage is selected for manufacturing purposes and the passage 15 may terminate short of surface 14. Passage 15 is also illustrated as being circular but it could be of any geometric shape with the benefits of a circle being that it may be shifted without removal while a square configuration would require lifting of an internal member, rotating the same and replacement to achieve the concepts of the invention.

The tip holder is generally designated 20 and includes, in the form shown, a generally circular, longitudinally extending, cylindrical member of a size to be received in passage 15. Seal rings 21*a*, 21*b* may be provided between holder 20 and passage 15 and a keeper such as C-ring 22 may be provided to locate and seal holder 20 within passage 15. A rotating handle 20*a* is provided on the upper end of holder 20.

A flat tip holding and part receiving passage 25 is provided transversely through holder 20. It should be understood that flat tips for airless sprayers may be provided with variously shaped exterior surfaces including location flats and passage 25 provides a first tip receiving area 25*a* formed to accomodate the exterior shape of a tip F and maintain the same in proper spraying position. At least a second seal 27 and pressure plate area 25*b* is provided in passage 25 to accomodate an O-ring seal 27 and movable pressure plate 28 therein and allow longitudinal movement for application of sealing and locating pressure to tip F. A locking cap 30 and receiving area 25*c* is longitudinally provided such that tip F, seal 27, pressure plate 28 and cap 30 are receivable and locatable within passage 25.

Figure 7:
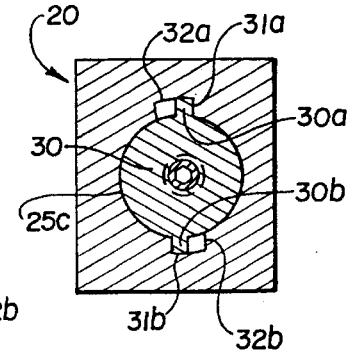
FIG. 7 is a vertical section taken substantially along Line 7—7 of FIG. 4 illustrating the cap and the tip locking feature of the unit.

Simple receiving and locking means are provided for closure cap 30 by providing longitudinally extending slots 31*a*, 31*b* adjacent cap receiving area 25*c* with a pair of normally offset ear receiving notches 32*a*, 32*b*, FIG. 7, adjacent the ends thereof to permit longitudinal insertion of cap 30 and partial rotation of the same for locking thereof.

Closure cap 30 provides a longitudinally extending body having radial ears 30*a*, 30*b* on one end thereof to be accomodated by notches 31*a*, 31*b*. The opposite surface 30*c* will conform to the shape of holder 20 and a pair of spanner location passages 33 are provided thereon to permit the limited rotation for locking of the same into notches 32*a*, 32*b*. Similarly passage 30*e* may be formed, for example, as at 30*d* to receive an Allen wrench for such rotation.

It should be noted that passage 30*e* serves as a material flow passage and passes entirely through cap 30.

As illustrated, pressure plate 28 consists of a generally flat, shouldered member having a threaded stem 28*a* thereon with a tool receiving depression 28*b* on the end of such stem. To accomodate threaded stem 28*a*, at least a portion of the passage 30*e* of cap 30 must be threaded. The aspect of the invention accomodated by such structure should be obvious. The tip F is inserted into passage 25, seal 27 placed thereagainst and the combination of plate 28 and cap 30 is placed therein. After locking of cap 30 into position, plate 28 is rotated to provide proper sealing pressure against seal 27 and tip F. Obviously plate 28 is apertured through itself and stem 28*a* for material flow.

The combination of threaded stem 28*a* of plate 28 and the threaded portion of passage 30*e* of cap 30 allows longitudinal movement of plate 28. This combination could be provided by other means such as a biasing spring or the like with the intent of the concept being to maintain sealing and spraying pressures in either direction of material flow.

In operation of the unit, should the tip F become clogged or even partially clogged, the entire tip holding unit 20 is simply rotated to cause material flow rearwardly through the tip F for flushing or cleaning thereof. Indents or other indicia may be provided between body 12 and rotatable tip holder 20 to insure positioning of the flow passage in either direction.

Various structural modifications may be made to the individual members described without departing from the basic scope of the invention. For example, tip F may be cupped to receive seal 27; both passage 15 and holder 20 could be of other geometric shapes; the material utilized could be other than that shown by the cross-hatching for metal and movement of plate 28 could be achieved through biasing means.

What is claimed is:

1. A rotatable, cleanable flat tip airless spray unit including:

a. a body having means to fluidly attach the same to a controllable, airless spray gun to receive material therefrom;

b. a material flow passage defined through said body;

c. a tip receiving passage in said body transverse to said material flow passage;

d. a tip holder received in said tip receiving passage and providing a transversely arranged tip receiving area and a cap receiving area;

e. a spray tip positioned in said tip receiving area;

f. a cap arranged in said cap receiving area and positionable therein;

g. a seal arranged between said spray tip and said cap;

h. said tip, cap and seal having a material flow passage therethrough;

i. at least a portion of said cap being moveable to apply sealing pressure to said seal and said spray tip; and, j. said tip holder being positionable within said tip receiving passage to allow material flow through said body, tip, seal and cap in a first position and in a second position reversed with respect to the first position, wherein said cap receiving area of said tip holder includes:

i. a cap receiving passage having a pair of slots extending longitudinally thereof and terminating in normally disposed ear receiving notches; and further wherein said cap includes:

i. a pair of outwardly directed ears receivable into said cap receiving passage with said ears positioned in said slots and being rotatable to shift said ears into said notches.

2. The airless spray tip unit as set forth in claim 1 further including a plate member threadably connected to said cap and means for rotating and longitudinally shifting said plate member independently of said cap.

3. The airless spray tip as set forth in claim 2 and said cap and plate member having an aligned, material flow passage therethrough.

4. The airless spray tip unit as set forth in claim 1 further including a plate member having a threaded stem, said cap having a threaded passage to receive said stem and means for rotating and longitudinally moving said plate member independently of said cap.

5. The airless spray tip unit as set forth in claim 4 wherein said plate member has a material flow passage therethrough.

6. The airless spray unit as set forth in claim 1 and said tip receiving passage in said body being generally circular and said tip holder being cylindrical in shape.

7. The airless spray unit as set forth in claim 1 and handle means for rotating said tip holder.

8. The airless spray unit as set forth in claim 1 and seal means between said tip holder and said body.

* * * * *